United States Patent [19]

Salina et al.

[11] 4,401,412

[45] Aug. 30, 1983

[54] HEAVY DUTY ELECTRIC PUMP CONTROL UNIT

[75] Inventors: Louis E. Salina; Joseph E. Lescovich, both of Bridgeville, Pa.

[73] Assignee: GA Industries Inc., Mars, Pa.

[21] Appl. No.: 268,673

[22] Filed: Jun. 1, 1981

[51] Int. Cl.[3] ..... F04B 49/00

[52] U.S. Cl. ..... 417/12; 417/28; 417/63

[58] Field of Search ..... 417/12, 63, 26–28, 417/44, 33

[56] References Cited

U.S. PATENT DOCUMENTS

| | | | |
|---|---|---|---|
| 2,646,205 | 7/1953 | Rosenschold | 417/12 |
| 4,083,657 | 4/1978 | Misener | 417/63 X |
| 4,273,513 | 6/1981 | Salina | 417/12 |
| 4,290,735 | 9/1981 | Sulko | 417/12 X |

*Primary Examiner*—Edward K. Look

*Attorney, Agent, or Firm*—Parmelee, Miller, Welsh & Kratz

[57] ABSTRACT

For use in connection with an electrically driven pump and check valve combination as used in municipal water and sewage plants wherein the check valve prevents the reverse flow of water from the pipeline to which the pump supplies water into the pump, as would otherwise happen in case of a pump failure or breakdown or temporary power failure, there is provided a pump director with a first timer that starts the pump operating as soon as a control switch is closed and power is available and, as soon as the pump motor is energized, a blue signal light flashes, but if pressure does not begin to build up in the pump outlet with the check valve closed, a flashing red signal will replace the blue and continue indefinitely until manually reset. If the pump does start to build up pressure, the flashing blue light will become steady whereupon a buildup of pressure continues and a flashing green light replaces the steady blue; and a second timer takes over under control also of a pressure switch to start opening the check valve and a limit switch is opened that cuts both timers out of the circuit and switches the flashing green light to a steady green light. In the event of an emergency, such as an unscheduled power failure, a damaged pump or motor, etc., a pressure switch losing pressure will trigger a fast emergency closing of the check valve and open the motor circuit.

10 Claims, 7 Drawing Figures

HEAVY DUTY ELECTRIC PUMP CONTROL UNIT

This invention relates to systems wherein liquid, most commonly water or sewage, is pumped through pipelines from a lower to a higher elevation, and applies essentially to heavy duty pumps and systems such as municipal water supply systems or municipal sewage transfer systems, and not infrequently to large industrial installations where water may be circulated for cooling purposes from wells, streams or settling ponds to some elevated outlet and the pump is usually operating against a static back pressure in the output line.

BACKGROUND

In a municipal water system, for example, deep well pumps may raise water to the ground level to supply heavy duty surface pumps which force the water through pipelines to an elevated standpipe or water tower or other reservoir from which it is distributed by gravity flow to individual users. In such a systems, the pump is operating against a pressure head of water which, should the pump be stopped, is then by gravity urged to flow back with damaging momentum through the pump to the source from which it was removed.

Various conditions arise, such as the loss of water supply to the pump, the shutdown of the pump because of an adequate level of water in the standpipe or reservoir, a broken pump shaft or disabled motor, or a power failure or other contingency. There may be normal shutdowns or emergency shutdowns. There may be normal startup operations, or an abnormality may develop in the startup requiring an immediate emergency shutdown.

It may be further explained that three types of protective valves are commonly employed in pumping stations of the kind to which this invention relates. The first is a diversion valve, such as will exhaust air from the pump inlet to atmosphere upon startup of the pump and the discharge to waste of the first liquid reaching the pump. For example, where a deep well pump is delivering water to the heavy duty pump on the surface, air which may have filled the well shaft during shutdown is first expelled to the atmosphere and should not enter the system to which the water is supplied. Also, in this case, the water first reaching the surface may be riled and contain sand or silt, and this, like the air, is exhausted before the output of the heavy duty pump enters the pipeline. A check valve is provided between the outlet of the pump and the header or pipe to which water is received from the pump. The main function of this valve is to prevent the backflow of water under the force of gravity from the header or pipe if the pump is shut down or through some mishap, power failure, loss of suction, pump or motor damage, or simply due to a lack of demand for water from the pump. In case two or more pumps deliver water to a common header, the shutdown of one pump would divert the output of the one pump back into the water source through the non-operating pump if such a reverse flow check valve were not provided in the output of each pump. It is to this pump and valve combination that this invention particularly relates.

The third valve usually provided in a pumping station having one or more pumps is a surge valve as disclosed in our copending application, the purpose of which is to divert a backsurge of water or liquid in the line to waste where a shock wave generated at the pumping station, such as the sudden stopping of a pump, results in a return surge of pressure, frequently of damaging proportions, unless it can be timely discharged to a waste outlet, as disclosed in our copending application referred to above.

BRIEF DESCRIPTION OF THE INVENTION

This invention is concerned with the second mentioned one of the three pump and valve systems above explained, that is, the check valve in the outlet between each individual pump and the header or pipe line to which it delivers liquid and which is located in the pumping station between the diversion valve and the surge valve, assuming all three to be used. It involves a common control system for correlating the operation of the check valve and the pump.

A check valve commonly provided for use with pumps as herein used is not of the usual swinging gate type but is one wherein the valve element is power operated, and preferably is of the type where there is a piston with one end fitted as a piston in a chamber forming a cylinder. The end of the element which is in this cylinder has a larger surface area than the other end which extends into the valve body to move onto or away from a valve seat in the body of the valve. This piston is held against the seat to keep the valve closed by liquid pressure in the cylinder, which in turn is controlled by one or more solenoid valves which, in turn, operate to lower the pressure in the cylinder when the fluid pressure in the pipeline exceeds the pressure in the inlet side of the valve body and seat, but opens the check valve when pressure on the inlet or pump side of the valve equals or exceeds the pressure at the outlet side of the valve. Other types of power operated suitable check valves are available using a flexible diaphram in place of a cylinder and piston, or even a reversible servomotor.

Our invention provides a control unit, sometimes herein termed a "box" because it is conveniently housed with a metal box of a type commonly used for electrical apparatus, but instead of being contained within a box, may have related components arranged on a panel which may or may not contain other electrical equipment. In either case, the combined apparatus will be herein termed a box or unit. As an actual box, it has a hinged cover on which are contrasting colored signal lights which, for identification and explanation but without limitation, will herein be referred to as blue, green, red and amber, the last being a neon light. This cover panel or box lid also has a hand operated switch which may be hand set from an "off" to an "on" position or moved to an automatic or "auto" position through which it may be operated from a remotely located station instead of by an attendant present within the pumping station.

The valve has an electrically controlled normal solenoid pilot (NSP) through which normal opening and closing of the check valve is effected along with the respective starting of the pump and shutting down of the pump, and an emergency solenoid pilot (ESP) through which an emergency operation of the check valve in effecting an emergency shutdown of the pump.

Within the box are three timers, i.e., valve initiate timer (VIT), valve delay timer (VDT) and power failure timer (PFT). Energizing of these timers, in turn, closes and opens, or effects closing or opening of various relay switches. In addition, the box has terminals arranged in two separate rows of ten terminals each, each two adjacent pairs leading to some external component in the overall combination, except one pair which connect to the activating source of electric power, so that connections with external components or circuits can be rapidly and accurately made.

Briefly, then, the invention provides a unit, conveniently pre-assembled to be connected into an electric pump-check valve combination for effecting the startup, monitoring the operation and closing down of a pump with the concommitant operation of its protective check valve and the display of signals informing the attendant of what is happening, be it a mechanical breakdown, a power failure, a motor failure, or other trouble.

The apparatus may be fully understood by reference to the accompanying drawing in conjunction with the following description, in which apparatus and sequence of operations are, for convenience, described and in which:

In FIG. 1 the check valve is in the process of effecting a normal closing.

Figure 1:
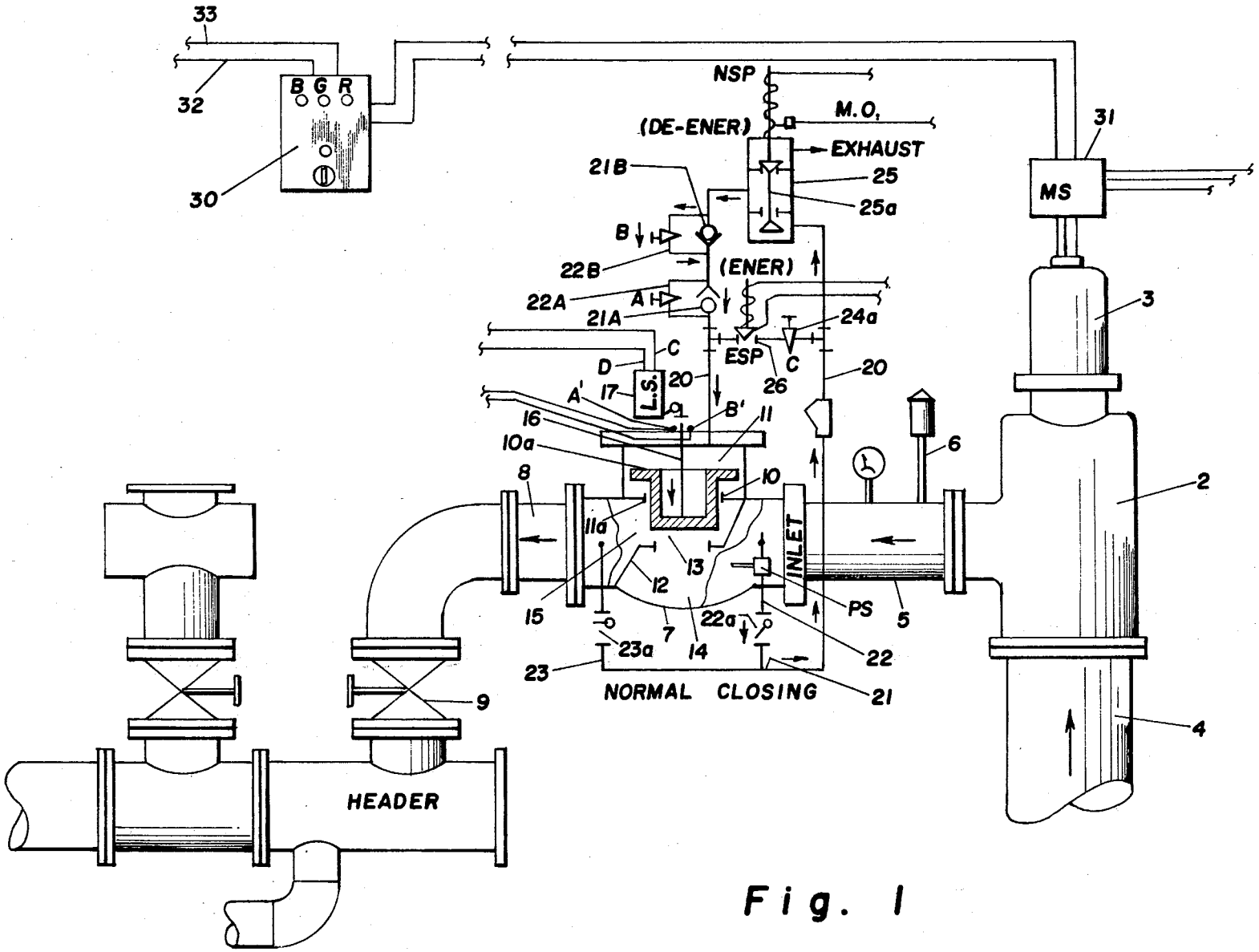
FIG. 1 is a schematic view showing schematically a typical pump unit connected into a header through a solenoid controlled check valve, one pump and one check valve only being shown, but where there might be one or more similar pumps with similar valves and controls.

For the most part, FIGS. 1, 2 and 3 relate to usual pumping station equipment, as hereinafter more fully appears, schematically illustrated but an understanding of which is important to the overall description of our invention. Referring first to FIG. 1, the numeral 2 designates a pump of a type commonly used in municipal water, sewage, and like pumping stations which is driven by an electric motor 3. The inlet pipe through which water from some source of supply, such as a well, stream, or collecting pool of some kind, is designated 4, and 5 indicates a typical outlet pipe with an air vent and water outlet 6 for venting air and particularly, in the case of water forced to the surface by a deep well pump, the initial discharge of water after shutdown containing silt may be harmlessly vented. The valve 6 is a well-known device with the valve comprising a ball around which air may escape but which, when the pump discharges water, will float the ball and thus close the valve against further escape of liquid. The pump outlet pipe 5 opens into a pump protecting check valve 7 known and commonly used in water pumping stations where large volumes of water are supplied to a distributing or disposal system which, in turn, has an outlet pipe 8 with a hand valve 9. The drawing indicates a second connection for another pump and valve unit on the same header, but which unit, of which there might also be more than one, is not shown since it would simply duplicate the one that is shown.

The check valve 7 is not of the familiar simple swinging gate type but is a power operated check valve, preferably the one here schematically shown, having a piston 10 in the form of a hollow cylindrical cup with a flanged upper end 10*a*, whereby the overall top area of the cup is of a larger diameter and hence has a greater area than the bottom of the cup which extends down into the interior of the valve body, while the flanged upper end of the cup is enclosed in a pressure cylinder 11. The lower end of this pressure cylinder is separated from the interior of the valve body by a rigid diaphram or partition 11*a* through which the cup portion of the piston 10 has a sliding fit. Unless otherwise qualified, either by specific terms or by context, the terms "valve" or "check valve" (as, for example, "the body of the valve") shall refer to the check valve 7.

Within the valve body there is a fixed partition 12 having a seat forming horizontal port 13 therein, separating the interior of the valve body into a lower or inlet chamber 14 and an upper or outlet chamber 15. The piston 10 seats over the port 13 to close the valve, and when it lifts from this seat, it opens the valve. The discharge pipe 5 from the pump opens in the lower chamber of the valve body and the outlet pipe 8 is connected into the upper chamber.

Figure 3:
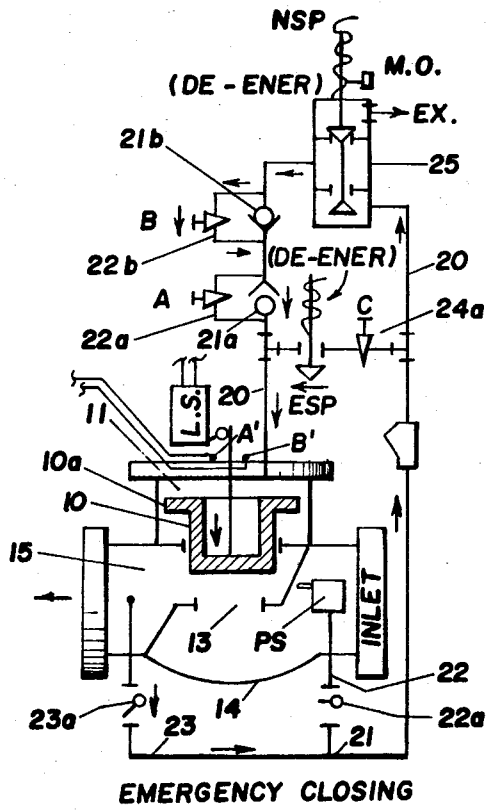
FIG. 3 is a view similar to FIG. 2 but with the fluid pressure and valve control circuit having changed to emergency shutdown of the pump with the rapid emergency closing of the check valve.
Figure 2:
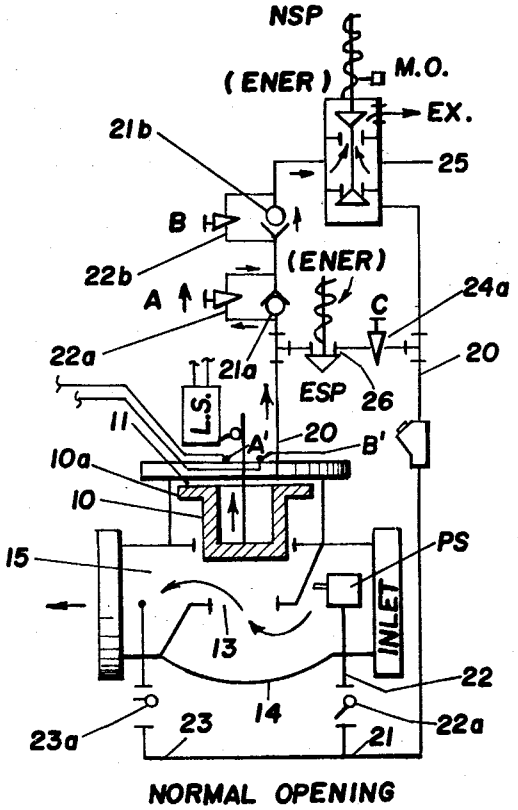
FIG. 2 is a schematic view of the check valve only with fluid pressure control circuit in the process of a normal pump startup and normal valve opening operation.

It is to be understood that the terms "up" and "down," "lower" and "upper" and "vertical" are used with respect to a valve as illustrated in FIGS. 1 to 3, but in an angle valve, the corresponding parts would be differently oriented and the foregoing terms, used in the "straight through" valve illustrated, will apply to similar parts in a valve differently oriented, as for example, an angle valve where the pipe 5 may be vertical and the pipe 8 horizontal.

Where the pressure in the lower chamber of the valve, that is, the inlet pressure, exceeds the pressure in the cylinder 11, the piston 10 will lift to open the port 13, but when the pressure in the lower chamber is less than or just equal to pressure in the cylinder 11, the piston 10 will remain closed or, if open, it will move to close the port 13. This is by reason of the upper end of the piston having an effectively larger area than the lower surface.

Figure 5:
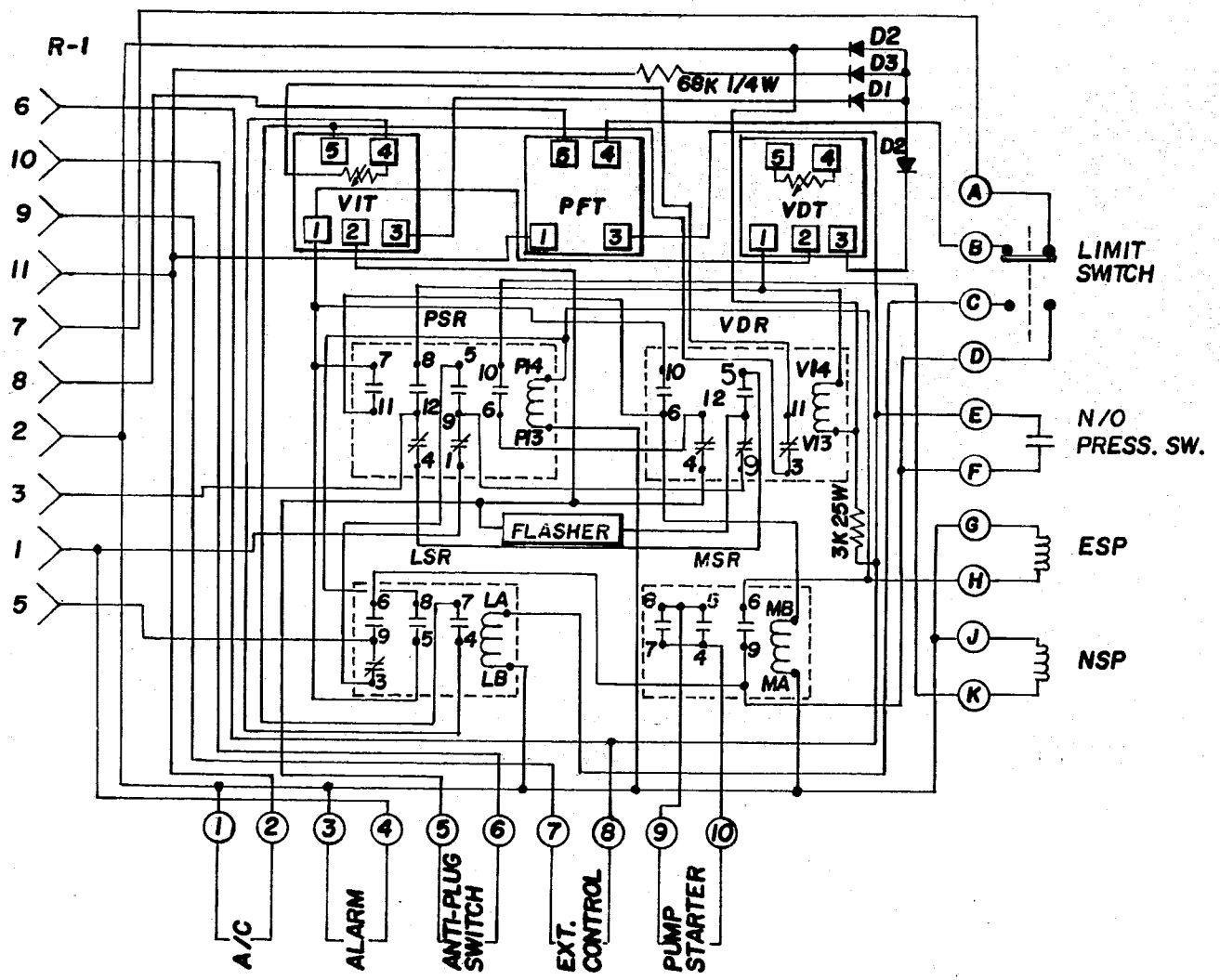
FIG. 5 is a wiring diagram showing a row of terminals diagrammed along the bottom front edge of the box and another row along the right side of the box bottom, these being not visible in FIG. 4. The view further shows a row of conductors along the left side that go to elements on the box lid.
Figure 7:
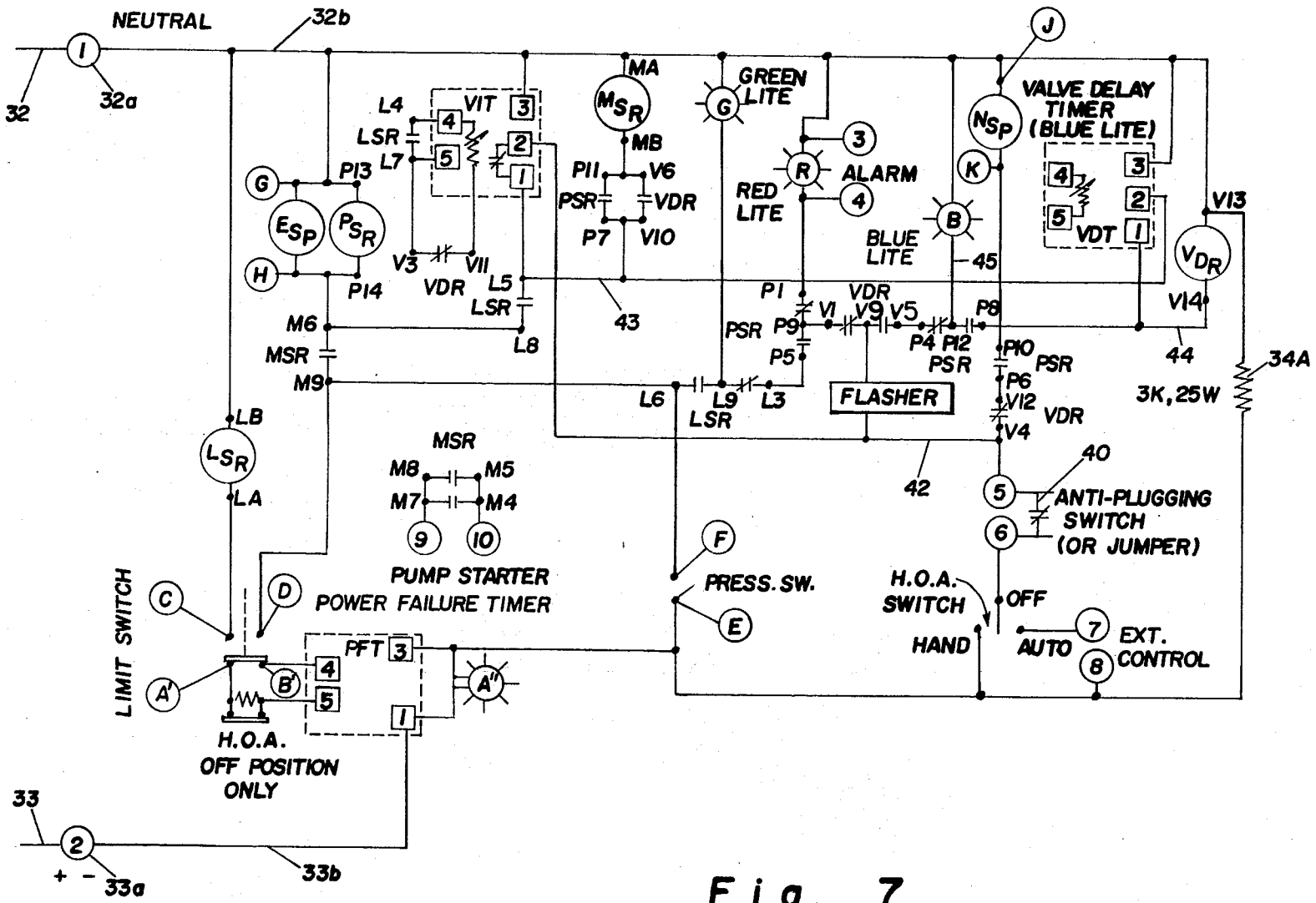
FIG. 7 is a composite schematic or functional circuit diagram from which the sequencing of the operations may be followed.

The pump check valve piston 10 has a rod 16 attached to it that is slidably passed through a seal, not shown, in the top of the cylinder 11 and which, as it moves up with the opening movement of the valve 10, closes a limit switch 17 but which, when the valve is about closed, clears the limit switch to allow that switch to open. However, as the limit switch seats in its closed position, it closes a circuit across contacts A and B (FIGS. 5 and 7).

There is a pressure loop comprising a relatively small diameter pipe 20 leading from the interior of the cylinder 11 to a branched pipe 21 having one branch 22 leading to the interior of the valve body on the inlet side or lower chamber and a second branch 23 leading to the interior of the valve body on the outlet side of the valve port 13, that is, the valve chamber 15. There is a conventional swinging gate type of check valve 22*a* in branch 22 and a similar check valve 23*a* in branch 23 and there is a pressure switch (PS) in branch 22 between check valve 22*a* and the valve body (see also E-F, FIG. 7). Both check valves 22*a* and 23*a* open outwardly from the interior of the valve body into pipe loop 21 so that the flow of liquid into the loop is always from the branch in which there is the higher pressure.

The loop 20 includes a normal solenoid operated pilot valve (NSP) which is also designated 25. It has a reciprocable valve element 25*a* and an upper chamber from which there is an exhaust port indicated by the arrow and notation "EXHAUST" on the drawing, FIG. 1, and in FIGS. 2 and 3 by the arrow and letters "EX". There is an intermediate chamber below the exhaust chamber and above a lower chamber. From the intermediate chamber there is indicated the left leg of the pipe loop 20 which extends downward from NSP, 25, and terminates in the top of cylinder 11. The upper end of the other leg of the loop 20 (right leg) opens into the lower chamber of NSP, 25. In FIG. 1, the NSP, 25, is shown with the parts in the process of effecting normal closing of the valve. In this view, the left side of loop 20 has an upper check valve 21B that is closed, causing operating fluid to flow, as indicated by arrows, through a shunt loop 22B in which an adjustable flow control hand valve B is indicated. Below this, the pipe 20 has a second check valve 21A that is reversed with respect to 21B, around which is a shunt loop 22A with a similar hand adjustable flow regulating valve A therein. It may be here pointed out that in FIGS. 1 and 3 the solenoid in the combined solenoid and spring at the top of 25 is deenergized, as indicated by the legend "De-Ener," where the exhaust port is closed, but in FIG. 2, for opening the exhaust port, the solenoid is energized.

This arrangement assures that under normal operating conditions a pump may be put into service, "on the line," or taken out of service at a controlled rate such that no sudden shock wave is produced in the line as might be of damaging magnitude. Assume, for example, that a pump is in service and is to be taken out of service by normal closing. To effect this, the normal solenoid pilot valve (25) is deenergized (from the box 30, as hereinafter more fully explained) to admit pressure from the inlet side of the pump check valve, as herein before described through lines 21 and 20 to the lowermost chamber of said pilot valve and flow from said chamber into the left side of the pipe loop 20. At the same time the valve 25*a* then closes passage of fluid from the intermediate chamber to the exhaust chamber. The flow of liquid into the left side 20 of the loop thereupon closes check valve 21B and the liquid flows at a rate controlled by the hand valve B in shunt loop 22B back into the left leg of loop 20 below check valve 21B. It thus forces check valve 21A open, minimizing any flow through the shunt loop 22A and enters the cylinder 11 of the pump check valve. The pressure in this cylinder builds up gradually because of the controlled flow established by the adjustable valve in loop 22B. However, because the top of the piston 10 of the check valve 7 is larger than its lower end, the gradual buildup of pressure in cylinder 11 forces the piston 10 gradually toward valve port 13, finally closing said port, thus gradually cutting off flow from the pump into pipe 8. Back pressure in the outlet is not effective to open the valve since any back pressure greater than pump pressure will open check valve 23*a* and close check valve 22*a* and thus override pump pressure in supplying fluid pressure through loop 21 to cylinder 11.

It should be here explained that the normal solenoid pilot valve (NSP) 25 is a spring biased valve which moves to the position shown in FIG. 1 under spring pressure, but is moved in the opposite direction by energizing the solenoid to overcome a spring schematically represented at the top of the valve. In other words, the coil diamgramed at the top of the NSP and also at the top of ESP indicates both a spring for urging the vertically movable valve element down and the solenoid when energized for lifting the valve element.

Figure 6:
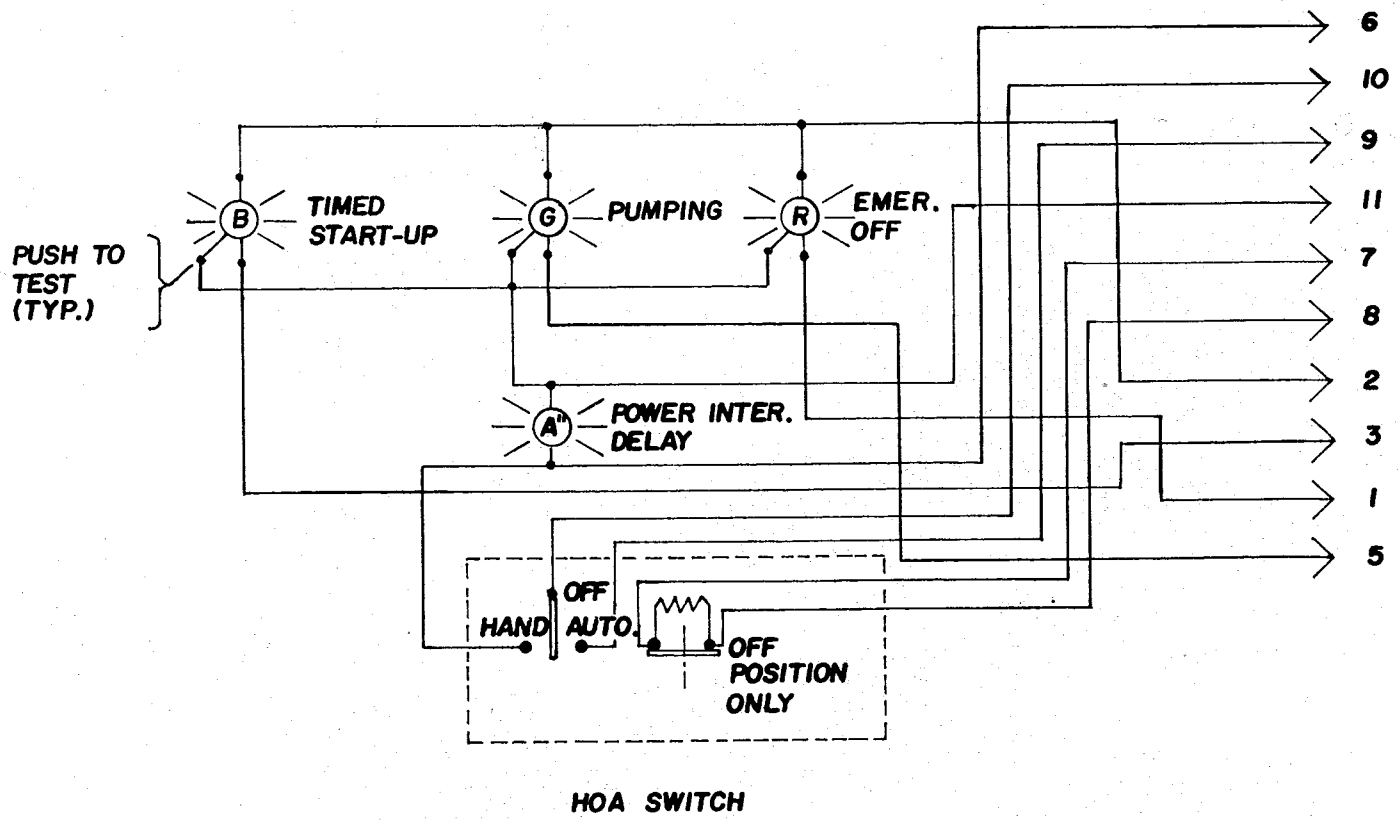
FIG. 6 is a complementary view to FIG. 5 showing the elements on the box lid.

It will be seen that as the valve piston 10 moves the final small increment from the position shown in FIG. 2 to the fully seated position, the rod 16 moves down to open the limit switch 17 across contacts C and D (see FIG. 6), but as it does so, it closes contacts A' and B' (see FIG. 7).

FIG. 2 diagrams the operation of the check valve under normal conditions when the pump is idle and then is put into operation. At this time the normal solenoid pilot valve (NSP) 25 is reversed from the position shown in FIG. 1 by energizing of the solenoid of the valve, pulling the valve 25 up to a position where flow through the loop into the lower chamber of the valve and into the intermediate chamber is shut off and the port from the intermediate chamber to the upper chamber and out of the exhaust is open. As pressure in the then closed check valve increases as the pump starts, the valve piston 10 is forced up, causing an outflow of liquid from the cylinder into the left leg of loop 20 against check valve 21A, closing that valve. The outflowing liquid from the cylinder must then flow through shunt loop 22A at the controlled rate permitted by the hand operated valve in this loop. The liquid may then flow through check valve 21B, which is reversed to 21A, into the intermediate chamber of NSP valve 25 and out the exhaust pipe. From this it will be observed that the pump check valve is normally restrained from opening any faster than fluid may escape through the loop and adjustable valve 20A.

In an emergency some condition may suddenly change from normal to abnormal, requiring an almost instant shutdown of the pump. To effect this, there is a crossover connector 24 beteen the right leg of the loop 20 and the left leg which provides a supplemental emergency passage for fluid from the right side of the pipe loop 20 to the left side that is in addition to the normal closing passage in FIG. 2 through NSP 25, check valve 21B and loop 22B and check valve 21A and loop 22A. This connector 24 extends from the right leg of the loop 20 below the normal solenoid pilot 25 to the left leg between the top of cylinder 11 and below the lower check valve 21A.

In this crossover connection there is a hand valve 24*a* which is normally fully open but which may be partially closed to regulate the closing speed of the check valve, and there is an emergency solenoid pilot valve (ESP) 26 that is normally closed by energizing its solenoid under normal conditions of operation and in FIGS. 2 and 3. In FIG. 3, valve 26 is open to allow crossflow from the right leg of pipe loop 20 to the left leg and directly into the cylinder 11, while at the same time the normal flow may also take place, as shown in FIG. 1. This will move the valve cup 10 down against its seat almost instantly. If the emergency is one where the control circuit will be deenergized for a sustained period of time, the hand valve in the crossover may be manually closed, but to be again opened when the pump is again put into operation.

THE PRESENT INVENTION

Figure 4:
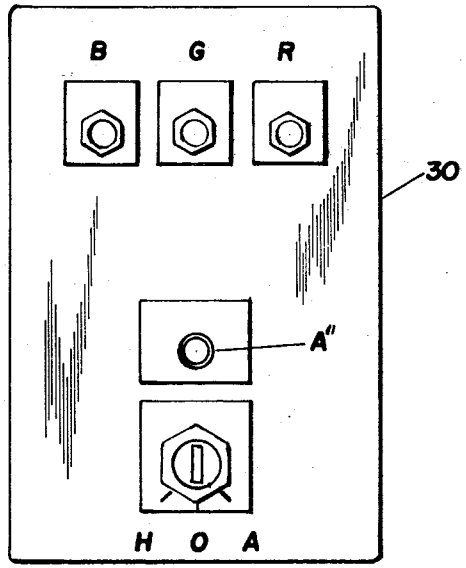
FIG. 4 is a face view of a typical box.

The present invention combines with the pump and check valve, as hereinbefore described, automatic supervision with visual signaling to notify an attendant as to what is happening at any time and prevent automatic startup if there has been an emergency shutdown for a predetermined time interval. The heart of this apparatus, which is sometimes referred to as the pump director, is desirably contained in what conveniently is a metal box, but it could be a unit affixed to a panel board where the components may be conveniently mounted, but which assembly is hereby included in the term "box". The box 30, shown in FIG. 4, comprises a panel as the hinged cover of a metal box across which there is a row of three electric lights of contrasting colors and here, for convenience, designated B for blue, G for green, and R for red. Below this there is an amber neon light A". These letters elsewhere (FIG. 7) are enclosed within circles with radiant lines, and in subsequent diagrams will be so displayed for easy identification.

Below the amber light, on the front of the box, is a switch designated "HOA" for "hand," "automatic" and "off". As later seen, when this switch is in the "off" position, the pump which the box controls is not in use. When it is turned to the "hand" position, the circuit will be energized to start and monitor the operation of the pump. When it is in the "auto" position, it means that instead of an attendant standing by to start the pump, it may be started and controlled from some remote location where the same sequence will follow as when the switch is turned to "hand," but, of course, the lights on the box are visible only locally. Whether operated locally or by remote control, it is a "manual" operation as that term is used herein.

Returning now to FIG. 1, the motor 3 that drives the pump 2 is supplied with power through a three-line commercial system, but the pump starter 31 which is controlled from the box 30, as indicated in this figure, through a two-wire circuit. The two-wire power supply to the box is designated in FIG. 1 by wires 32 and 33 which are connected in a usual way to draw current from the same commercial power source that supplies current to the motor 3, this being a conventional arrangement.

In FIG. 7, 32*a* and 33*a* are the terminals in the box through which current is supplied to the box and the circuits in the system; 32*b* and 33*b* outline the two lines of current flow in the box as well as the entire system, and it will be seen that these two lines are the main lines in the system. Starting with terminal 33*b* at the bottom of the diagram, there is a current path from line 33*b* to line 32*b* through amber neon light A and resistor 34A causing the amber neon light to light for a time period determined by the resistor valve imposed across terminals 4 and 5 of said PFT. At the expiration of this time period the terminals 1 and 3 of the PFT conduct and the neon light goes out, indicating that the HOA switch has a current path from light 33*b* and the box can commence a normal operation.

Referring to FIG. 5, it should first be noted that the circled numbers at the bottom and circled letters at the right side are not reference numerals but identifications applied to the terminals in the actual product. The box is shown with a row of terminal connectors along the front at the bottom of the box, with circled consecutive numbers (1) to (10). At the bottom of the box at the right side as seen in Fig. 5 there are a series of similar connectors with circled consecutive letters (A) to (K). For convenience in keeping various elements oriented there are indicated at the left side of the box, although not actually visible, a series of ten conductors with nonconsecutive numbers, each enclosed within forklike parentheses, the numbering ranging between (1) and (11) but with no numeral 4 in the series. These are flexible connectors for including the elements physically located on the box cover in the circuitry within the box. The circuit diagram in FIG. 4 may be followed by one skilled in the art for duplicating the invention, but the invention may be more easily understood and explained by reference to FIG. 7.

FIG. 7 is a simplified or functional circuit for the overall operation of the director by duplicating certain components, as for example the HOA switch above explained, is in part schematically indicated in the lower left corner of FIG. 5 and is again more completely diagramed above and inwardly from the right lower corner of the same figure, this being to avoid the maze of crossing wires. Again at the right side of the figure the circled letters VDR for "valve delay relay" has its serving arm contacts above and to the right of the panel marked "FLASHER" and elsewhere the letters VDR appear outside a circle at diverse locations in the diagram. The motor starter relay (MSR) has relay swing arms and contacts at separated locations. This conventionalized illustration is widely used by those skilled in the art in lieu of a complete diagram such as that shown in FIG. 6.

Within the box are three timers designated in FIG. 7 as VIT (valve initiate timer), VDT (valve delay timer) and PFT (power failure timer). The amber neon light is on the box cover (FIG. 4), as are the lights, B, G, and R, standing for "blue," "green," and "red." The HOA manually operating switch is on the box cover. The flasher, represented as a rectangle across which appears the word "FLASHER" is located inside the box. There are several relay operated switches physically located in the box, but in the circuit diagram (FIG. 7) they are located where, for convenience, their circuits may be more easily followed. In FIG. 7 they are diagramed as large circles with three letters, the last of which is R, as in (LSR) for "limit switch relay" and (VDR) for valve delay relay, and (MSR) for motor starter relay, etc. The relay switches are shown as confronting parallel lines in the several circuits which they control, as will hereinafter be more fully explained.

Relays VDR and PSR are four-pole, double-throw relays. Relay contacts not used are omitted from the diagram. On VDR the contacts used are V1, V9 and V5 and V6, V10, V3 and V11, V4 and V12. PSR contacts which are used are P1, P9 and P10 and P7, P11, and P4, P12 and P8. Relays MSR and LSR are three-pole, double-throw relays, and the contacts used comprise the initial letter of the relay followed by contact numbers, as L4 and L17, L6 and L19, L9 and L8. MSR contacts used are M6 and M9, M8 and M4, and M7. Coil terminals have the initial followed by letters A and B, as LA and LB.

Referring to FIG. 7, 32*a* indicates one terminal and 33*a* is the other terminal. As here indicated, 33*a* is one side of a continuous loop extending from 32*a* in the upper left corner to the right, down the right side in which there is a blocking resistor 34A electrically separating, in effect, the upper half of the loop as just described and the lower half, beginning with the lower end of resistor 34*a* to the lower right corner of the figure, then horizontally, with a jog to PFT (power failure timer) connector 3.

When electric current is applied to terminals 32*a* and 33*a* with the HOA switch off, the amber light A" will light and remain lighted for a brief period. This period is determined by the minimum timing characteristics of PFT with terminals 4 and 5.

In following FIG. 7 particularly, it may be helpful to keep in mind that the three timers are outlined as squares and that the timing is regulated by potentiometers indicated by a resistor with an arrow placed diagonally across it. Relay contacts are indicated by spaced short parallel lines. If the contacts are normally closed (n/c) when the relay is deenergized, to be opened when the relay is energized, there is a diagonal line across the parallel lines, but if the contacts are normally open (n/o) when the relay is deenergized, there is no such diagonal line. There are three timers, the one herein sometimes termed "the first" is the valve initiate timer VIT. It is so designated because it monitors the opening of the check valve after valve delay relay contacts V3 and V11 have closed. In this particular instance the contacts are indicated as closed since they are in VDR circuit and not the VIT circuit or the limit switch relay circuit.

The second timer, which is the first to be energized in the startup of the pump, is the VDT or valve delay timer. It is so called because it controls the valve delay relay which delays an opening of the check valve until the pump has produced sufficient pressure before the timer has timed out to indicate a successful pumping cycle has started to warrant opening of the check valve.

The third timer is the power failure timer PFT which operates only when the manually operated HOA switch is in either of the "on" positions and a power failure or interruption occurs delaying automatic startup of the pump for a preset period after power is restored, as, for example, five minutes. This gives adequate time to permit restart or to open the HOA switch. If, however, it is desired to start the pump sooner, the timer is of a type which, if the HOA switch is opened for six seconds and then reclosed, the five minute delay will be aborted and the VDT will immediately close the VDR relay and initiate the startup cycle.

When the HOA switch is shifted to the "H" position, a circuit will be closed from the lower branch of the power loop to the anti-plugging switch (this being a switch to prevent the power flow to the pump motor if the pump is turning backwards due to a back flow of water from the line through the pump to the well or other source of water); but since an anti-plugging switch is not always used, a jumper 40 is here shown across these terminals in place of the switch. From terminal 5, the current path extends upwards (as viewed in the drawing) and is blocked by open switch contacts PSR, P6 and P10, but there is a closed path through line 42 to [2] of VIT (valve initiate timer). Current flows from [1] of VIT and line 43 to [2] of VDT (valve delay timer) and through this timer to [1], and from [1] connects to line 44, completing a circuit to line 32*b* through VDR (valve delay relay). The flasher is then energized, the VDR contacts V9 and V5 being then closed, and V1 to V9 being opened. A pulsed current from the flasher now travels through contacts V9 and V5 and across contacts P4 to the vertical line 45 in which the blue lampbulb B is included, the upper end of 45 being joined to power line 32*b*. This flashing blue light indicates to the operator that the startup is taking place in a usual manner.

The energizing of relay VDR completes a circuit between line 43, VDR contacts V10 and V6 and motor starting relay MSR to line 32*b*, energizing the pump motor starter, FIG. 1. After the pump starts, air and dirty water, if any, may be first vented from connection 5 between the pump and the valve 7, but as the air is exhausted and pressure starts to build up, PSR (pressure switch (E) (F)) closes. Normally open (N/O) PSR contacts P11 and P7, as shown in FIG. 7, now close and parallel the closed circuit between VDR contacts V6 and V10. When this relay closes, P4–P12 open and P12–P8, P12 being the swing arm identified with relay PSR. This opens the current path through the flasher, and as PSR contacts P6 and P10 close, there is a current path from the HOA switch through VDR contacts V4 and V12 and PSR contacts P6 and P10 to energize NSP (normal solenoid pilot as diagrammed in FIGS. 1–3). At the same time a circuit excluding the flasher will be closed from line 42 to line 43 through VIT 2 and 1 and now closed contacts P8–P12 to cause signal B to burn steady.

However, as the check valve 10 opens, it breaks the circuit across limit switch (LS) contacts A and B and closes contacts C and D.

If the blue light has not turned from flashing to steady by the time VDT times out, thereby deenergizing VDR, the flashing blue will discontinue and flashing red will ensue by opening of contacts V9–V5 and reclosing of V9–V1 contacts. At the same time the alarm (3) (4) will be sounded.

Deenergizing relay VDR also opens n/o (normally open) VDR contacts V6 and V10, thereby deenergizing MSR and shutting down the pump.

If pressure does develop and the check valve is sequenced to open, or if, having opened and the pump has been operating normally and for any reason the presence is interrupted, the operations set forth in the two preceding paragraphs will occur and the ESP (emergency solenoid pilot) will be deenergized to close the valve with the sutting down of the pump.

Assuming now that startup has proceeded to a point where pressure sufficient to effect opening of the check valve has developed, the following occurs:

(1) Normally open (n/o) solenoid pilot valve ESP closes, enabling operation of the valves when called upon to do so. The blue light goes from flashing to steady blue, as previously explained, by the opening of n/c (normally closed) PSR contacts P4 and P12, and the closure of n/o (normally open) PSR P12 and P8.

(2) Closure of n/o PSR contacts P11 and P7 assures continuation of MSR energization after VDT times out, thus retaining contacts V6 and V10 in their normally open condition.

(3) The blue light, having turned steady, will remain lighted until the timer VDT has timed out, thereby deenergizing VDR.

(4) With the timing out of the blue light, VDR normally open contacts V1 and V9 will close, and PSR contacts P5 and P9 will be closed, and normally closed LSR contacts L3 and L9 will be closed, establishing a circuit through the flasher, across contacts V1–V7, contacts P9–P5, and L3–L9 to the green light and line 32, and flashing of the green light takes place.

(5) Deenergizing of VDR also causes n/c VDR contacts V12 and V4 to energize the normal solenoid pilot NSP through closed n/o PSR contacts P10 and P6, thereby commanding the check valve to open at a normal rate. When the valve goes off its seat, the limit switch goes off contacts A and B and closes contacts C and D, energizing LSR and closes n/o contacts L6 and L9 and opens n/c contacts L6 and L9, changing the flashing green to a steady green. Steady green indicates that the pump is operating and all conditions are operating normally.

Closing of n/o LSR contacts L4 and L7 times out VIT by shorting out timing terminals [4] and [5].

Closure of n/o LSR contacts L5 and L8 continues to supply energizing current to MSR for continuous pump operation after VIT times out.

In normal shutdown, turning the HOA switch to the "off" position deenergizes the NSP and causes the valve to close at a normal rate.

When the check valve 10 has closed to about 97% of its full travel, the n/o limit switch contacts C and D open, deenergizing LSR. Opening of n/o LSR contacts L5 and L8 deenergizes MSR opening n/o MSR contacts M8 and M5 and M7 and M4, shutting down the pump motor.

Several contingencies may arise during the operation of the pump, which the "box" or pump director herein described will take care of.

If while the pump and valve are performing normally either the emergency solenoid pilot (ESP) or the normal solenoid pilot (NSP) should have its coil burn out, closing the valve without a proper command (i.e. without the HOA switch being turned to the "off" position), the pump will shut down by the opening of limit switch contacts C and D, and a flashing red light will appear because the flasher is still energized (HOA "on") and connected with the red light through n/c VDR contacts V9 and V1 and n/c PSR contacts P1 and P9.

Any time a flashing red condition exists, the box or unit is recorded inoperative until it is reset by moving the HOA switch to the "off" position at least momentarily. This removes the power and resets the VDT.

It at any time while the unit is operating normally and a power failure occurs of a duration of more than six cycles (of a 60-cycle current), the ESP closes the valve at a predetermined rate, depending on the setting of hand valve 24*a*. The current failure shuts down the pump motor and this, of course, results in the opening of the limit switch.

When power is restored, the power failure timer PFT prevents an immediate startup until the timer has timed out, provided that the HOA switch has not been manually moved to the "off" position after the power failure occurred and before the power supply was restored. The startup sequence upon restoration of power and assuming no manual interference with the circuit as it was when the power went off, then requires no manual intervention, but there will be a predetermined time lapse before the pump is started.

If, however, after power restoration following a power failure one wishes to start the pump immediately, he may manually turn the HOA switch to "off" and, after six seconds or so, immediately return it to "on". This shorts out the timing relay terminals [4] and [5] of the power failure terminal, avoiding the normal power failure time period for which the resistor is designed.

It has been previously explained that deenergizing VDR energizes the normal solenoid pilot (NSP) to effect a normal opening of the valve (FIG. 2). Should any circumstance arise to prevent the valve from opening before timer VIT times out, the deenergizing of MSR will shut down the pump and the flashing red light will appear.

The pump, the valve, the pressure switch and limit switch and the normal solenoid pilot and the emergency solenoid pilot are known in the art, and the present invention provides in and on the box all of the directing functions and the sequencing of the operations with two rows of easily accessible terminals arranged for ready identification. Connection of the respective wires of an existing installation with the easily identified pairs of terminals on the box provides for automatic supervision and direction of the operation of a single pump, and in a pumping station with muliple pumps, a box for each pump along with a single surge valve protection unit afforded by the invention disclosed in our herein identified application provides automation and protection for an entire pumping station.

We claim:

1. For use in a pumping station where an electrically driven pump with a current supply circuit transfers large volumes of liquid, hereinafter termed "water", from a supply source into a main against the static pressure in the main and/or the concurrent output of other pumps into the same main, wherein there is a check valve between the pump and the main for preventing backflow of water from the main into the pump when the pressure at the pump outlet is lower than the pressure in the main, the check valve opening and closing under normal conditions by a normal solenoid pilot valve (NSP), but under an emergency condition by an emergency solenoid pilot valve (ESP), the check valve having a limit switch (LSR) which normally closes when the pump is not operating but which, under the operation of the pump at start-up, opens said normally closed start-up position and closes a second circuit which then sustains the operation of the pump as long as the pump continues to operate normally but which, upon a lowering of the pump pressure to a level where the line pressure in the main is higher than the pump output pressure to said pump start-up position, the improvement comprising:

(a) a pump director unit having a two-wire circuit connected with the current supply circuit to the pump whereby the pump director is primarily controlled only if the electric current supply line is energized;

(b) said two-wire circuit of the pump director unit having a hand-operated switch HOA through the closing of which the unit is energized, the unit having:

(1) a valve delay relay, VDR, (2) a valve delay timer, VDT, (3) a motor starting relay, through the energizing of which a starter for the pump motor will be energized, (4) a first electric lightbulb (B), (5) a second electric lightbulb (R), (6) a flasher circuit between HOA and B, (7) a parallel circuit to lightbulb B shunted around the flasher circuit;

(8) said parallel circuit comprising a connection between the unit and a pressure activated switch between the pump and check valve;

(c) said circuit and relays being so connected that when HOA is closed, VDT will be energized to close relay VDR, the closing of which energizes MSR to start the pump motor, the closing of VDR connecting the lightbulb B into the flasher circuit, causing it to flash indicating that the pump starting circuit is proceeding normally, and if the pressure switch builds up pressure at the pump outlet before VDT times out, said parallel circuit between HOA and bulb B will close and VDR will be de-energized to open the flasher circuit;

(d) said HOA, VDT, and VDR circuits being such that if the pressure switch on the pump outlet has not reached a predetermined pressure when VDT times out and VDR opens, a circuit will then be closed from the flasher through de-energized VDR to said second bulb R, indicating by the flashing of R that the pump has lost suction or failed to operate in some other respect, thereby signaling an attendant to open HOA.

2. The pump director defined in claim 1 wherein a means is provided for de-energizing said first signal means if it is operating continuously before said timer has timed out and to then effect the intermittent operation of a third signal means indicating a continuing buildup of pressure in the pump outlet.

3. The pump director defined in claim 2 in which a second timer is energized when the third signal means begins to operate intermittently and, through a connection with the normal solenoid valve on the check valve, initiates the opening of the check valve.

4. The pump director defined in claim 3 in which there is a limit switch on the check valve which closes a first circuit until a predetermined pressure in the pump outlet has increased to a pressure higher than the reverse pressure toward the pump from said receiving means and wherein there are connections between the pump director and the pump that are effective, if the limit switch has not opened before said second timer times out, said second signal will be intermittently operated to warn of malfunction but wherein the opening of the check valve before said second timer times out to close the second pair of limit switch contacts, the circuit to said third signal will turn to continuous operation and so continue as long as the pump is operating to keep said switch closed on the second contact, and means responsive to said limit switch and said second timer for intermittently operating said second signal if the limit switch has not opened before the second timer times out.

5. The pump director defined in claim 4 in which the signals are three individually distinct electric lights, and the circuit includes a flasher to effect intermittent operation and the continuous operation of the signals is effected through circuits by-passing the flasher.

6. The pump director defined in claim 5 in which there is no flasher by-pass circuit for the second signal.

7. A pump director for an electric powered water pump which delivers water in a pipe against the static pressure in the pipe and wherein there is a check valve between the pump outlet and pipe to which water is delivered, and wherein there is a limit switch on the valve that opens one circuit as the valve opens and closes another, with the opening and closing of the valves controlled by a normal solenoid under usual conditions of operation and by an emergency solenoid valve at a faster speed for closing the valve under emergency conditions, the pump being electrically operated from a power supply circuit the improvement comprising an automatic pump director which comprises a unit that may be located in the pumping station at a location removed from the immediate vicinity of the pump, said pump director being powered from the same power supply circuit as the pump motor whereby the director may be activated only when the power circuit to the pump is energized, said pump director comprising:

(a) a manually operated switch for controllably connecting or disconnecting the director with the pump power supply circuit;

(b) a first timer means that is energized by the closing of the switch;

(c) means energized by the timer which is connected by external wiring for de-energizing the electric pump motor;

(d) means on the pump director also energized by the timer for energizing a pump operating signal through a flasher to signal a normal startup of the pump, the pump having a pressure switch in its outlet connected with the pump director and connected with the pump operating signal for switching the flasher upon closing of the pressure switch from the flasher to a continuous current if the pump is operating to build up pressure in the pump outlet before the timer times out whereby the first signal then stops flashing and indicates a normal startup of the pump, and there is a second signal which is controlled through said timer if the pump outlet pressure fails to build up before the timer times out to cause such second signal to de-energize the first signal and operate the second and thereby warn an attendant of a pump startup failure;

(e) a second timer that is energized by the first timer but only if it is energized in response to a normal continuing buildup of pump pressure in the pump outlet before the first timer has timed out and a third signal and circuit controlled by the second timer for energizing said third signal through the flasher to indicate a continued satisfactory buildup of pressure;

(f) means in the indicator connected with the limit switch on the check valve arranged to eliminate the flasher to the third switch if the limit switch has operated to signal opening of the check valve before said second timer has timed out, thereby signaling through the continuous operation of the third signal with no flasher that the pump and check valve are operating normally.

8. The pump director defined in claim 7 whereby if said limit switch has not eliminated the flasher before the second timer has timed out, the second signal will be energized to continuously flash a warning signal.

9. The pump director defined in claim 7 wherein any subsequent opening of the limit switch due to pump failure by reason of loss of pump suction for any cause or burnout of the solenoids which operate the solenoid valve, or motor breakdown will open the circuit to said third signal, a de-energizing of the pump motor and the flashing of said second signal.

10. The pump director defined in claim 9 where a means is provided for an attendant to manually direct the operation of the normal solenoid pilot valve for effecting normal shutdown of the pump and the closing of the check valve, and also there is provided a means for manually operating from the pump director the opening of the emergency solenoid pilot valve to be operated in an emergency where rapid closing of the check valve is deemed necessary.

* * * * *